US008070082B2

(12) United States Patent
Sued et al.

(10) Patent No.: US 8,070,082 B2
(45) Date of Patent: Dec. 6, 2011

(54) SHREDDER AND/OR SHREDDER HEAD WITH PIVOTABLE TOP PANEL

(76) Inventors: Charles Sued, Brooklyn, NY (US); Aron Abramson, Brooklyn, NY (US)

( * ) Notice: Subject to any disclaimer, the term of this patent is extended or adjusted under 35 U.S.C. 154(b) by 255 days.

(21) Appl. No.: 12/133,014

(22) Filed: Jun. 4, 2008

(65) Prior Publication Data

US 2009/0302142 A1 Dec. 10, 2009

(51) Int. Cl.
*B02C 23/00* (2006.01)

(52) U.S. Cl. ..... 241/37.5; 241/101.3; 241/285.3

(58) Field of Classification Search ..... 241/100, 241/236, 101.3, 37.5, 285.1–285.3
See application file for complete search history.

(56) References Cited

U.S. PATENT DOCUMENTS 3,711,034 A * 1/1973 Ehinger ..... 241/100
4,192,467 A * 3/1980 Hatanaka ..... 241/34
4,637,560 A * 1/1987 Goldhammer ..... 241/100
D299,035 S * 12/1988 Nishibori et al. ..... D18/34.6
4,821,967 A * 4/1989 Moriyama ..... 241/37.5
4,957,243 A 9/1990 Kanagaki
D342,965 S 1/1994 Duke
5,685,499 A 11/1997 Gimmy
5,975,445 A 11/1999 Ko
6,065,696 A 5/2000 Tsai
D448,794 S 10/2001 Wei
6,390,397 B1 5/2002 Ko
6,595,444 B2 * 7/2003 Schwelling ..... 241/37.5
D502,961 S 3/2005 Lo
6,965,294 B1 * 11/2005 Elliott et al. ..... 340/5.2
7,083,131 B2 8/2006 Ting
7,195,185 B2 3/2007 Matlin
7,213,780 B2 5/2007 Chen
7,226,009 B2 6/2007 Matlin
D550,760 S 9/2007 Beno
D611,525 S * 3/2010 Sued et al. ..... D18/34.5
2004/0164192 A1 8/2004 Chang
2007/0029420 A1 2/2007 Radstrom
2007/0034723 A1 2/2007 Joachim
2007/0034725 A1 2/2007 Duh

* cited by examiner

*Primary Examiner* — Faye Francis
(74) *Attorney, Agent, or Firm* — Garcia-Zamor IP Law; Ruy M. Garcia-Zamor

(57) ABSTRACT

A shredder having a pivoting top panel which may include a display which may reduce potential safety hazards. The shredder may include a top panel thereon that is moveable between a first position, in which the top panel covers the slot, and a second position, in which the top panel is positioned to allow access to the slot.

19 Claims, 14 Drawing Sheets

SHREDDER AND/OR SHREDDER HEAD WITH PIVOTABLE TOP PANEL

BACKGROUND

The present invention is generally directed to shredders and, more specifically, to a shredder having a pivotable top panel with an integrated display.

Conventional shredders can have one or more slots designated for the insertion of material to be shredded, and the action of the shredder is determined by the user's selection of one of three operating modes. The first operating mode is an "off" mode in which the shredder blades are deactivated and no shredding of material can take place. Material placed in the shredder slot may come in close proximity to the shredder blades but the material will not by itself activate the shredder. The second operating mode is an "on" mode in which the shredder blades continually rotate to shred any material inserted into the shredder. The third operating mode is an "automatic" mode in which the shredder blades are automatically activated when the shredder detects that material is being inserted into the shredder. The "automatic" mode is advantageous in that material can be sporadically shredded without having to continually turn the shredder on and off. This makes it easy to open mail and immediately shred those items which are unneeded and may contain personal information.

However, the use of shredders in "automatic" mode can be problematic. The user can unintentionally leave the shredder in "automatic" mode after all shredding tasks are completed. The lack of noise generated from shredder blade movement and the difficulty of visually determining the shredder state by observing the selectable control or interpreting a visual indicator may lead the original user or a new user to believe that the shredder is in the "off" mode. The original user or a new user who is unaware that the shredder is waiting to detect the insertion of material may position fingers or clothing near or inside the uncovered shredder slot, which may lead to serious injury.

Safety hazards are also present in those shredders operating in "on" mode, as a user may leave the shredder in "on" mode while unattended. A user who is interrupted by another task may leave the shredder on when leaving the work area, or a user with hearing impairment or in a noisy environment may be unaware the shredder is still in the "on" mode. If the noise from the running blades is not sufficient to alert the original user or a new user to the shredder state, it may be difficult to visually determine the shredder state.

A general safety hazard with a conventional shredder is the ability of any person to activate the shredder blades. The danger is greater when the shredder is in a home environment where a young child may approach an unmonitored shredder. The location of the shredder controls may allow a young child to place the shredder into the "automatic" or "on" mode and insert material into the shredder while risking serious injury.

It may be advantageous to provide a shredder that includes a pivotable top panel with an integrated display that may alert a user to the current state of the shredder, and that may allow the a user to securely cover the shredder slot in a way that protects the display and provides increased safety for others who come into contact with the shredder.

SUMMARY

Briefly speaking, one preferred embodiment of the present invention is directed to a shredder. The shredder includes a shredder head whose major surface defines a slot adapted to receive material to be shredded. A plurality of shredder blades are disposed within the shredder head and are adapted to shred the material inserted into the slot. At least one selectable control is located on the major surface. A top panel is pivotably located on the major surface of the shredder head and incorporates a display. The top panel is moveable between a first position, in which it covers the slot and the selectable control, and a second position in which the top panel is positioned to allow access to the slot and selectable control.

In a separate aspect, the present invention is directed to a shredder. The shredder includes a shredder head whose major surface defines a slot adapted to receive material to be shredded. A plurality of shredder blades are disposed within the shredder head and are adapted to shred the material inserted into the slot. A top panel is pivotably located on the major surface of the shredder head and incorporates a display. The top panel is moveable between a first position, in which it covers the slot, and a second position in which the top panel is positioned to allow access to the slot. The shredder includes a shredder basket positioned to receive material shredded by the plurality of shredder blades, a shredder housing enclosing the shredder basket. The shredder housing includes a front panel that is pivotable about a vertical axis between a closed position which encloses the shredder basket, and an open position in which the shredder basket can be accessed. The front panel of the shredder housing extends along the front side of the shredder to a portion of each of the lateral sides of the shredder basket.

In a separate aspect, the present invention is directed to a shredder. The shredder includes a shredder head whose major surface defines a slot adapted to receive material to be shredded. A plurality of shredder blades are disposed within the shredder head and are adapted to shred the material inserted into the slot. A top panel is pivotably located on the major surface of the shredder head and incorporates a display. The top panel is moveable between a first position, in which it covers the slot, and a second position in which the top panel is positioned to allow access to the slot.

In a separate aspect, the present invention is directed to a shredder head. The shredder includes a shredder head whose major surface defining a slot adapted to receive material to be shredded. A plurality of shredder blades are disposed within the shredder head and are adapted to shred the material inserted into the slot. A top panel is pivotably located on the major surface of the shredder head and incorporates a display. The top panel is moveable between a first, closed position, in which it covers the slot and the selectable control, and a second, open position in which the top panel is positioned to allow access to the slot and selectable control.

In a separate aspect, the present invention is directed to a shredder including a shredder head having a major surface defining a slot adapted to receive material to be shredded. At least one selectable control is located on the major surface. A top panel is pivotally located on the major surface and is moveable between a first position, in which the top panel covers the slot and the at least one selectable control, and a second position, in which the top panel is positioned to allow access to the slot and to the at least one control. A plurality of shredder blades are disposed within the shredder head and are adapted to shred the material inserted into the slot. The top panel further comprises a display therein.

In a separate aspect, the present invention is directed to a shredder including a shredder head having a major surface defining a slot adapted to receive material to be shredded. A top panel is pivotally located on the major surface and is moveable between a first position, in which the top panel covers the slot, and a second position, in which the top panel is positioned to allow access to the slot. A plurality of shredder blades are disposed within the shredder head and are adapted to shred the material inserted into the slot. The top panel includes a display therein. The display is configured such that the display is not viewable when the top panel is in the first position. A shredder basket is generally positioned to received material shredded by the plurality of shredder blades. The shredder housing has front and lateral sides and encloses at least the shredder basket. The shredder housing includes a front panel that is laterally pivotable about a generally vertical axis between a closed position, in which access to the shredder basket is prevented, and an open position, in which the shredder basket can be accessed. The front panel extends along the front side of the shredder housing and along a portion of each of the lateral sides of the shredder housing.

In a separate aspect, the present invention is directed to a shredder including a shredder head having a major surface defining a slot adapted to receive material to be shredded. A top panel is pivotally located on the major surface and is moveable between a first position, in which the top panel covers the slot and, and a second position, in which the top panel is positioned to allow access to the slot. A plurality of shredder blades are disposed within the shredder head and are adapted to shred the material inserted into the slot. The top panel includes a display therein. The shredder head is configured to automatically move the top panel into the first position if no material has been inserted into the slot for a predetermined period of time.

In a separate aspect, the present invention is directed to a shredder head including a major surface defining a slot adapted to receive material to be shredded. A top panel is pivotally located on the major surface and is moveable between a first position, in which the top panel covers the slot and, and a second position, in which the top panel is positioned to allow access to the slot. A plurality of shredder blades are disposed within the shredder head and are adapted to shred the material inserted into the slot. The top panel includes a display therein.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENTS

Figure 1:
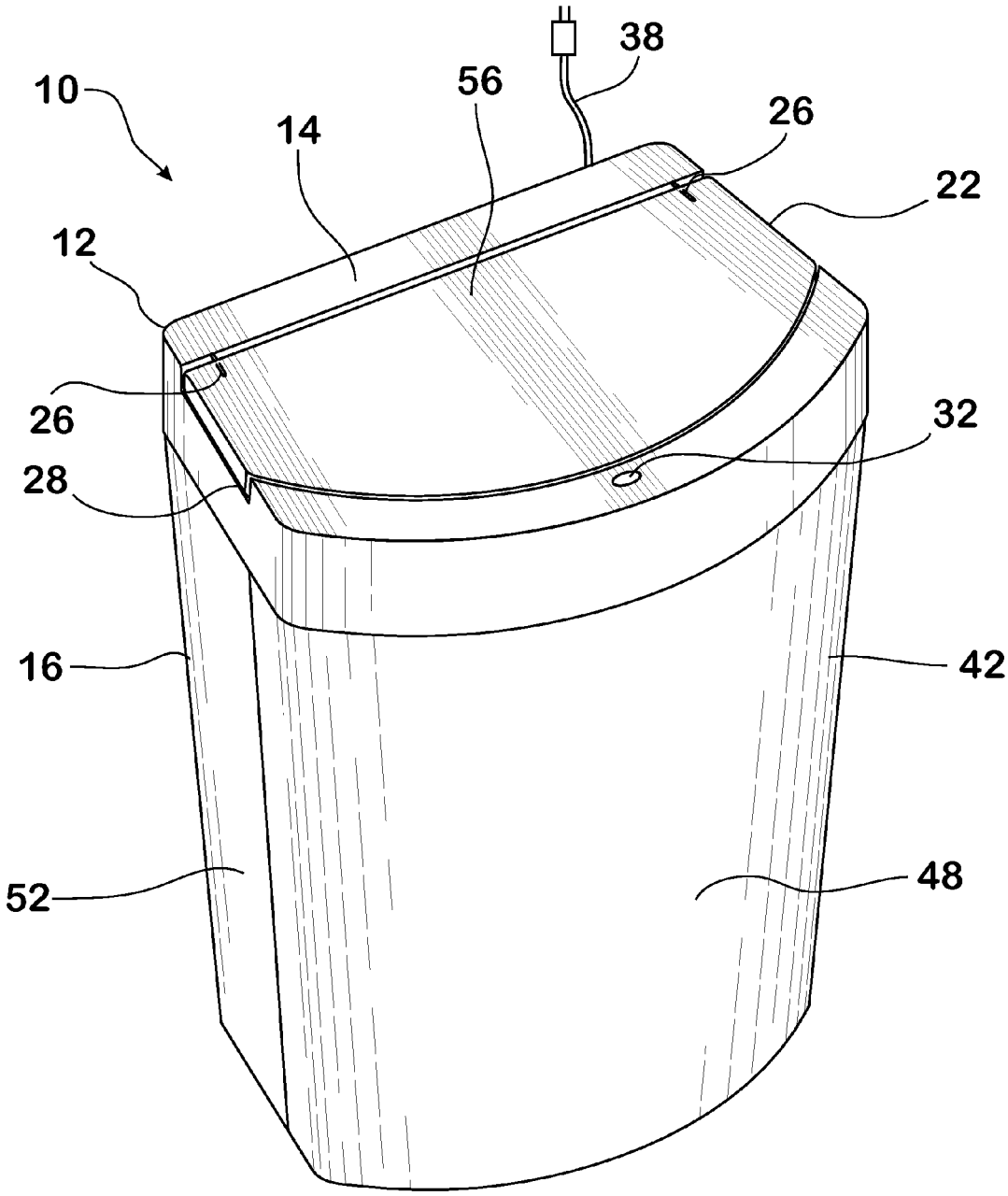
FIG. 1 is a perspective view of a shredder according to a preferred embodiment of the present invention, showing the top panel in its first, closed position which preferably covers the slot and the at least one selectable control; the front panel of the shredder housing is shown in its closed position, in which it encloses a shredder basket (not shown); It is preferred that when the top panel is in the first position, that the top panel is generally flush with the outer surface of the shredder to provide an attractive aesthetic appearance; Similarly, it is preferred, but not necessary, that the shredder housing include a front panel that is laterally pivotable about a generally vertical axis between a closed position (shown in FIG. 1), in which access to the shredder basket is prevented, and an open position (shown in FIG. 9), in which the shredder basket can be accessed; The front panel preferably extends along the front side of the shredder housing and along a portion of each of the lateral sides of the shredder housing to provide the entire shredder with a flush attractive aesthetic appearance when the top panel is closed and the front panel is closed.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the shredder and/or shredder head and designated parts thereof. The term "selectable control", as used in the claims and the corresponding portions of the specification, means "any one of a physical switch, a touch switch, a button, a voice activated switch, a control knob, a remote control switch, or any other known operating mode selection device". The term "activated state", as used with selectable control, means that the selectable control has been manipulated so that the selectable control is set for a particular function. For example, if the selectable control is a simple switch, then the activated state may be having the switch turned to another position and if the selectable control is a touch sensor, then the activated state may be initiated by depressing or touching the sensor in a predetermined manner. The term "display", as used in the claims and in corresponding portions of the specification, means "any one of a liquid crystal display, a plasma display, or any other suitable display mechanism." The term "biometric information", as used in the claims and in the corresponding portions of the specification, means "any biometric information including, but not limited to fingerprint scanning, palm scanning, voice recognition, facial recognition, retinal scanning, and the like." The language "at least one of 'A', 'B', and 'C'," as used in the claims and in corresponding portions of the specification, means "any group having at least one 'A'; or any group having at least one 'B'; or any group having at least one 'C';—and does require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Referring to FIGS. 1-13, wherein like numerals indicate like elements throughout, there is shown a preferred embodiment of a shredder 10 according to the present invention. Briefly speaking, the shredder 10 includes a top panel 22 that has a display 24 integrated therein. The integration of the display 24 allows superior shredder control options that are easier for users to operate. The display 24 also makes monitoring of shredder operations simpler. Additional features (such as biometric controls, remote locks, automatic shutdown, and touch screen controls) may be integrated with the top panel 22 to provide a shredder that has even more efficient functionality and versatility. The preferable integration of the display 24 with the top panel 22 also allows for the shredder to have a modern flush look that is sleekly styled when the top panel is in the closed position (as shown in FIG. 1). Applicants discovered that another advantage of preferably integrating the display 24 with the top panel is the increased ease of replacement of the display by merely changing the top panel 22. Applicants also discovered that an advantage of preferably having the display 24 hidden when the top panel 22 is closed is that it reduces the attraction of the shredder to young children and babies. This further increases the safety of the shredder 10 of the present invention.

The shredder 10 of the present invention is preferably constructed of a polymer for maximum rigidity. However, the shredder can be constructed of any suitable material without departing from the scope of the present invention.

The shredder 10 preferably receives power from an outlet via a power conduit 38, such as an electrical cord. However, the shredder 10 can be powered by batteries or by any other suitable power source without departing from the scope of the present invention.

Figure 2:
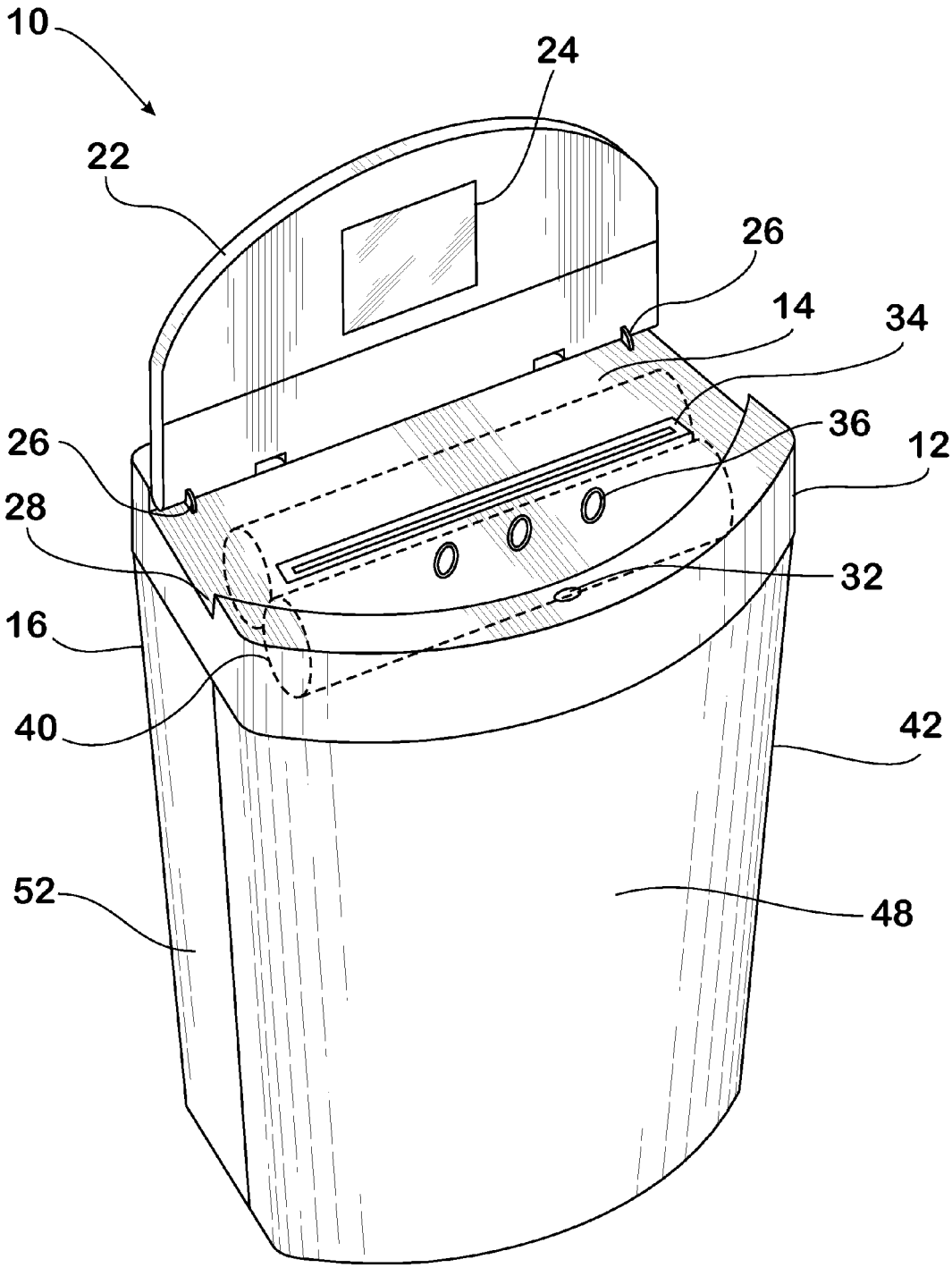
FIG. 2 is a perspective view of the shredder of FIG. 1 illustrating the top panel in its second, open position which allows access to the slot and the at least one selectable control which, in this case, is formed by three separate controls; The top panel includes a display which can incorporate any suitable display technology and is preferably only viewable when the top panel is not in the closed position; the display can be a touch screen that further incorporates selectable controls therein.

Referring to FIGS. 1 and 2, the shredder 10 includes a shredder head 12 and a shredder housing 16. While the preferred shredder 10 has a generally rectilinear shape with a level top surface 56 and an arcuate member comprising the front surface 48, those of ordinary skill in the art will appreciate from this disclosure that the shredder 10 can have any shape without departing from the scope of the present invention.

The shredder head 12 includes a major surface 14 defining a slot 34 adapted to receive material to be shredded, and at least one selectable control 36 is preferably located on the major surface 14. A top panel 22 may be located on the major surface 14 of the shredder head 12, and may be attached to the shredder head 12 at a pivot 26. Alternatively, the top panel can be connected via a hinge (not shown), gearing, or any other suitable connection means.

Figure 5:
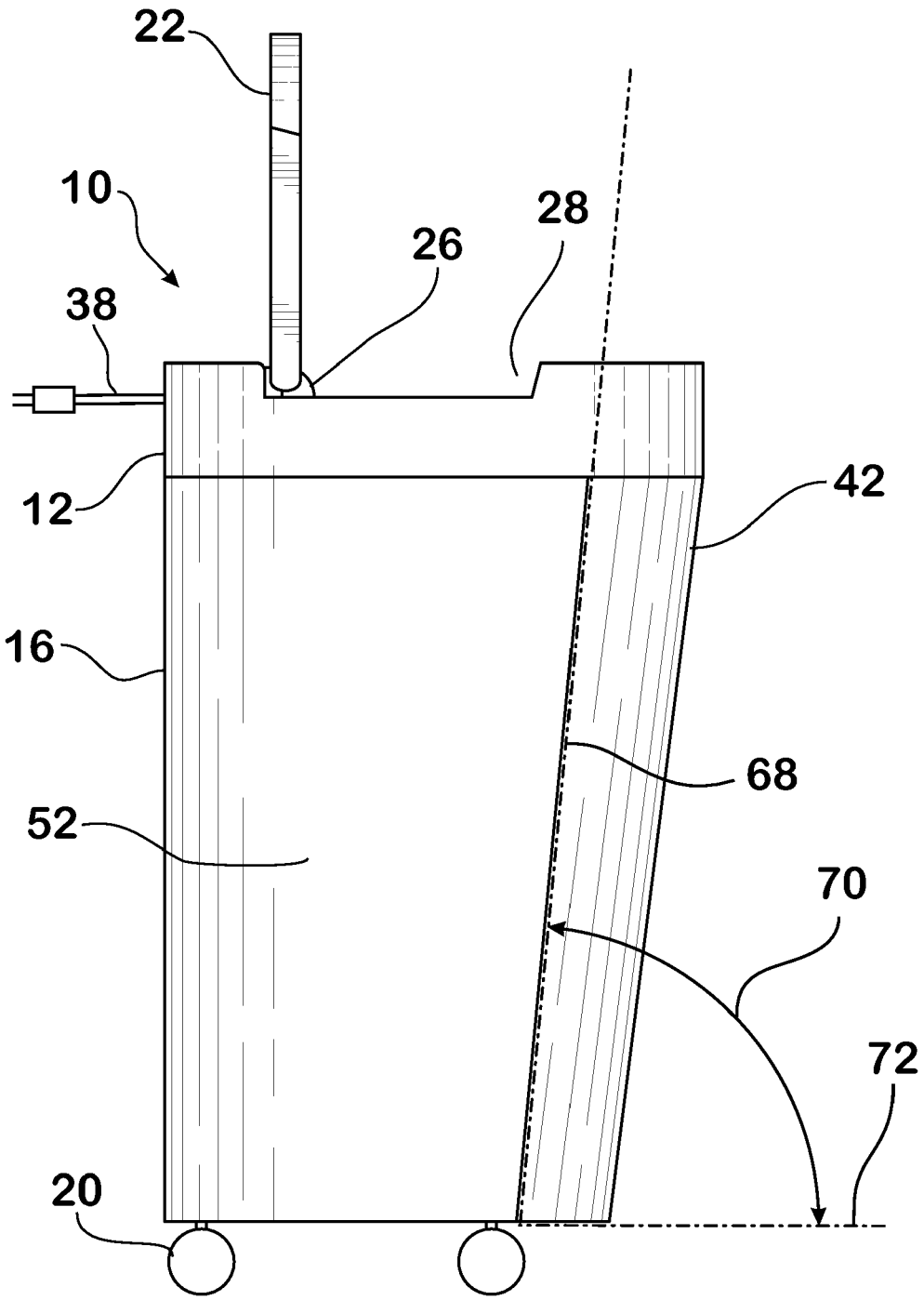
FIG. 5 is a left side elevational view of the shredder of FIG. 1 illustrating the top panel in its second, open position; the pivots for the top panel may be visible as is the recess in which the top panel rests when located in the first position; An edge of the front panel which extends partially along the lateral side of the housing is shown; This edge is preferably proximate to a generally vertical axis (shown by dashed line 68) about which the front panel preferably pivots.

The top panel preferably includes a display 24. The display is preferably, but not necessarily located generally centrally on the top panel 24 and may be configured to be hidden from view when the top panel 22 is closed. The pivot 26 or other connection mechanism enables the top panel 22 to move between a first, closed position and a second, open position. In the first, closed position, the top panel 24 covers the slot 34 and possibly the at least one selectable control 36. A front panel 42 preferably comprises the majority of the front surface 48 of the shredder housing 16, and pivots along a generally vertical axis 68 to allow access to the shredder basket 18 which is seated in the interior of the shredder housing 16. The generally vertical axis is preferably defined by the hinge connecting the front panel 42 to the shredder housing. Referring to FIG. 5, those of ordinary skill in the art will appreciate from this disclosure that the term "generally vertical axis 68", as used in the claims and in the corresponding portions of the specification, means "extending generally upwardly from the shredder base to form an angle 70 with a plane 72 defined by the shredder base of at least forty five (45) degrees".

Referring to FIG. 1, one embodiment of the present invention preferably includes a shredder 10 with a shredder head 12 and shredder housing 16. The top panel 22 is shown in its first, closed position, and the top panel is preferably positioned in a recess 30 defined by the major surface 14 of the shredder head 12. While the top panel 22 is in its first, closed position, the display 24 is preferably not viewable, and the top panel 22 is preferably positioned to cover the slot 36 and protect the display 24. Not only does the top panel 22 protect the display 24 by covering it, but it also reduces any attractive nuisance that may be created for small children due to the reflectivity of the display 24.

The top panel 22 preferably extends to the lateral sides of the shredder head 12 to form a portion of the lateral surfaces 52, 54 of the shredder. The exposed surface of the top panel 22 is preferably flush with the non-recessed portion of the major surface 14 of the shredder head 12, such that in this configuration the shredder 10 has an aesthetically pleasing appearance. The front side 48 of the shredder 10 is preferably formed by an arcuate member which is shared by the shredder head 12 and the front panel 42 of the shredder housing 16, and which forms a smooth and aesthetically pleasing front surface 48. In its first, closed position the forward edge of the top panel 22 forms a parallel arc which complements the shape of the front surface 48 of the shredder 10.

Referring to FIG. 2, the top panel 22 is shown in its second, open position, in which the display 24 is visible to the user and can provide visual information to the user. In this configuration, the slot 36 is exposed, and the user can access the at least one selectable control 38 to put the shredder 10 into an operational mode. The shredder has at least one operational mode, which may consist of one or more of an "automatic" mode and an "on" mode. In the "automatic" mode, a sensor in the slot 36 is activated to detect material placed into the slot. When material is placed into the slot 36 a controller activates the shredder blades 40, which shred the material. In the "on" mode, the shredder blades 40 continuously operate to shred any material inserted into the slot. In either mode, the shredder 10 preferably returns to the "off" mode when the top panel 22 is moved from its second, open position to its first, closed position.

The display 24 is preferably comprises a liquid crystal display with sufficient illumination to be visible in a low lighting situation. However any other suitable display such as a plasma display or an organic light emitting diode display can be used, and the display can incorporate any type of illumination without departing from the scope of the present invention. Furthermore the display 24 may include touch screen controls to allow the elimination of separate controls from the shredder if desired. During normal operation of the shredder, the display 24 may provide information regarding the current operating mode, including if the shredder state is adapted to shred a particular class of material.

The display 24 may include a touch screen which can incorporate a biometric sensor and/or other selectable controls therein. For example, the display may include alphanumeric touch screen icons to allow the activation of the shredder to require entry of a particular code or biometric information. Similarly, the shredder housing may include a lock to prevent the front panel from being opened unless a code is entered via the display 24 or other selectable control. To increase security and to prevent children from playing in the shredded material, the shredder 10 may require that a code or biometric information be entered via the display 24 prior to disengaging the front panel to allow opening thereof.

The display 24 may also provide warnings when an excessive amount of material inserted into the slot 36, or when maintenance of the shredder 10 is required, such as lubrication of the shredder blades 40. In a situation when the shredder 10 is left in an activated mode without material being inserted into the slot 36, the display may alert the user to an impending automatic shutoff. That is, when the shredder 10 detects that the top panel 22 is in the second, open position and that material has not been inserted into the slot for a predetermined period of time, then the shredder may automatically move the top panel 22 into the first, closed position and/or deactivate the shredder blades 40. The predetermined period of time is preferably three minutes, but can vary as desired without departing from the scope of the present invention. Furthermore, the selectable controls may allow a user to vary the predetermined period of time prior to shredder blade deactivation and top panel closure to any desired time. The rotation of the top panel 22 may be accomplished using gearing, a linkage arrangement, solenoids, or any other suitable closing and/or opening mechanism.

For example, in one embodiment of the current invention the shredder 10 includes a timer control as one of a plurality of selectable controls 36. The timer control is adapted to allow a user to set the duration of time that the shredder will remain in "automatic" or "on" mode. The display 24 visually informs the user of the time remaining, and at the expiration of the timer the shredder returns to the "off" mode. The timer control may also be configured to automatically return the top panel 22 to its first, closed position after the completion of the set time.

In another embodiment of the present invention, a securing mechanism 30 is adapted to prevent the top panel from moving from the first, closed position to the second, open position. The control 32 for the securing mechanism 30 may take the form of a key lock, combination lock, switch, or any other suitable securing device. For example, the control 32 may be a biometric sensor without departing from the scope of the present invention. One non limiting example of a suitable biometric sensor is the MBF Solid State Fingerprint Sensor manufactured by Fujitsu. Details regarding one possible construction of a fingerprint sensor is set forth in U.S. Pat. No. 7,235,853, entitled "Fingerprint Detection Device and Method of its Manufacture, and Apparatus for Forming a Protective Film", which issued on Jun. 26, 2007, and which is hereby incorporated by reference in its entirety as if fully set forth herein. While two examples of biometric sensors have been mentioned, those of ordinary skill in the art will appreciate that any suitable biometric sensor can be used with the shredder 10 of the present invention without departing from the scope of the present invention. For example, the biometric sensor can be configured for fingerprint recognition, palm recognition, voice recognition, facial recognition, retinal scanning, temperature recognition, or for detection of any suitable biometric parameter. The biometric sensor is in communication with the shredder 10 and is adapted to detect predetermined biometric information. When activated, the biometric sensor preferably causes the top panel 22 to automatically move from the first, closed position to the second, open position and activates the plurality of shredder blades 40. The biometric sensor can be configured to accept predetermined biometric information that includes multiple users or a single user without departing from the scope of the present invention. Alternatively, the biometric sensor may be configured to activate the shredder blades. Those of ordinary skill in the art will appreciate from this disclosure If that biometric sensor can be integrated with the display 24 without departing from the scope of the present invention. Similar controls may be used to secure the front panel of the shredder housing without departing from the scope of the present invention.

In another embodiment of the present invention, the securing mechanism 30 is a lock which must be disengaged prior to moving the top panel. The control for the securing mechanism 32 allows the user to disengage the lock, and after disengaging the lock the user can rotate the top panel from the first, closed position to the second, open position and activate the shredder using the at least one selectable control 38.

In another embodiment of the present invention, a selectable control 32 is positioned on the shredder head 12 such that it can be accessed when the top panel 22 is in its first, closed position. When activated, the control 30 causes the top panel 22 to automatically move from its first, closed position to its second, open position. When the top panel 22 is in its second, open position, the control 30 causes the top panel 22 to automatically move from its second, open position to its first, closed position. The movement of the top panel 22 to its first, closed position preferably causes the plurality of shredder blades 40 to be automatically deactivated. The movement from the first, closed position to the second, open position can be activated by voice command when at least one selectable control 36 is configured to recognize a particular command from a user.

In another embodiment of the present invention, when the top panel 22 is in its first, closed position, the shredder 10 is in its "off" mode. If the user moves the top panel 22 from the first, closed position to its second, open position, the shredder 10 is put into the "automatic" mode. In the "automatic" mode, a sensor in the slot 36 is activated to detect material placed into the slot. When material is placed into the slot 36 a controller activates the shredder blades 40, which shred the material. The shredder 10 returns to the "off" mode when the top panel 22 is moved from its second, open position to its first, closed position.

Figure 3:
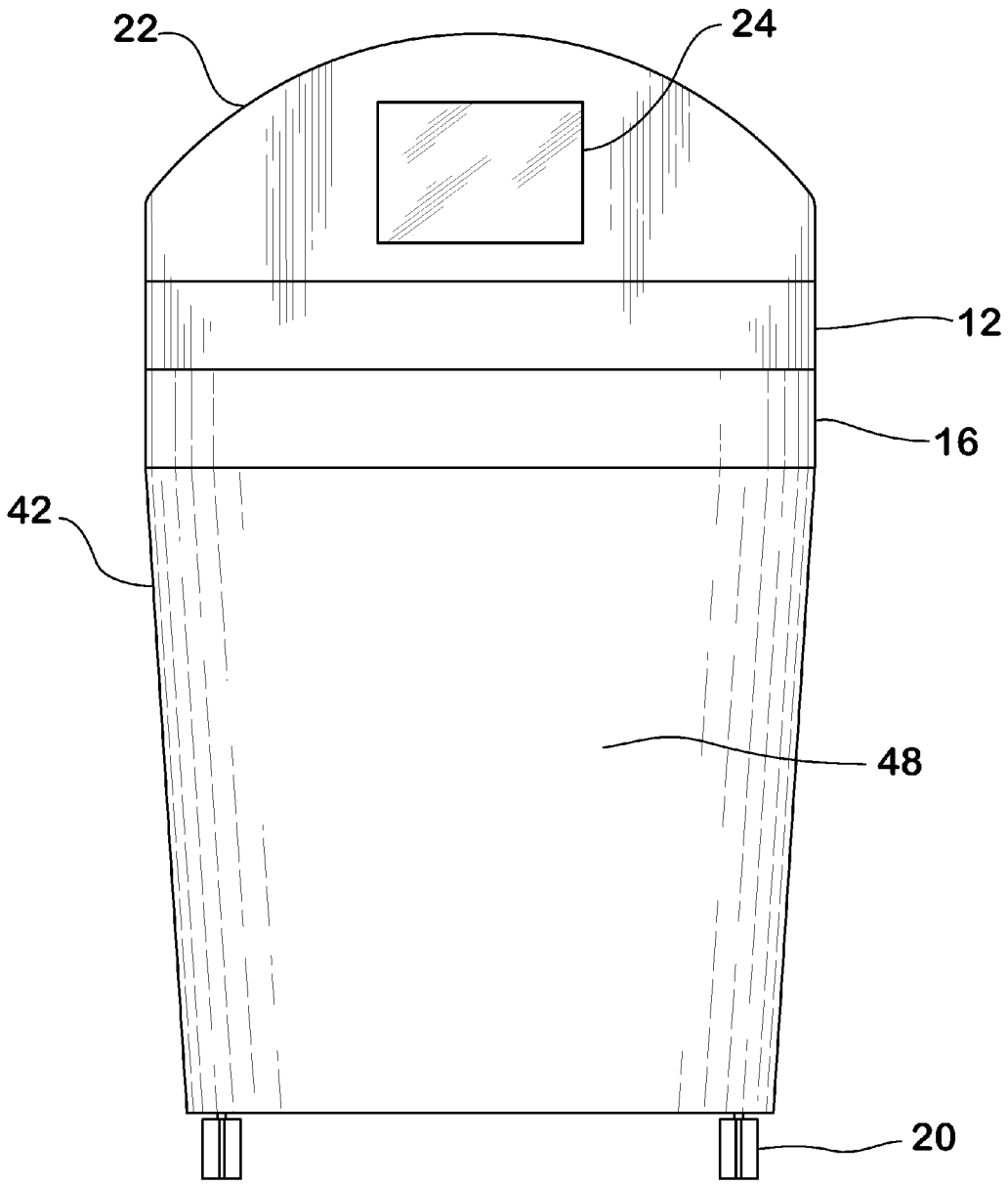
FIG. 3 is a front elevational view of the shredder of FIG. 1 illustrating the top panel in its second, open position, in which the display can preferably be viewed from the front side of the shredder; When the front panel extends along a portion of the lateral sides of the shredder the front of the shredder housing has a generally continuous, smooth appearance.

Referring to FIG. 3, the shredder display 24 is preferably clearly visible from the front of the shredder 10 to allow a user to generally operate the shredder 10 from the front side of the shredder 10 with full view of the display 24. The majority of the front surface 48 of the shredder housing 16 comprises a movable front panel 42. The front panel 42 is shown in its closed position, in which access to the shredder basket 18 is prevented. Wheels 20 located on the bottom surface 58 of the shredder housing 16 allow the shredder to be rolled into its desired location. The wheels 20 are preferably casters which enable maximum maneuverability of the shredder 10.

Figure 4:
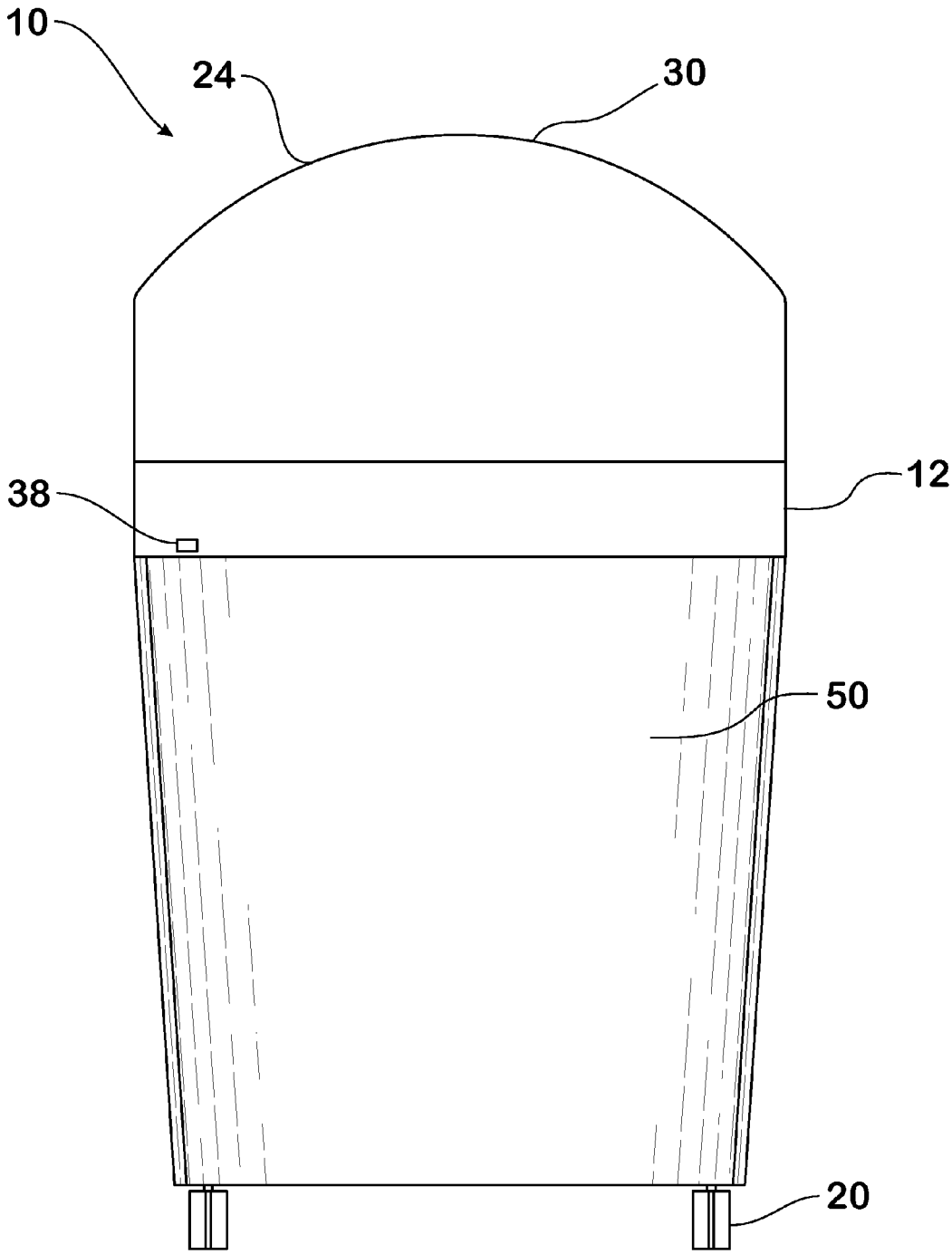
FIG. 4 is a rear elevational view of the shredder with the front panel in its second, open position.

Referring to FIG. 4, the shredder 10 of FIG. 1 is shown in rear view with the top panel 22 in its second, open position. The display 24 is preferably not viewable in this view. The power conduit 38 is preferably attached to the back side 50 of the shredder 10.

Referring to FIG. 5, the shredder 10 of FIG. 1 is shown in a left side view with the top panel 22 in its second, open position. The top panel 22 is preferably attached to the shredder head 12 at the pivot 26, and preferably rotates about this pivot 26. In its second, open position, the top panel 22 preferably forms an angle of approximately ninety (90) degrees from the major surface 14 of the shredder head 12. However, the top panel 22 can form any angle from the major surface 14 of the shredder head 12 without departing from the scope of the present invention. The shredder head 12 preferably defines a recess 28 for receiving the top panel 11 when it rotates into its first, closed position.

Figure 6:
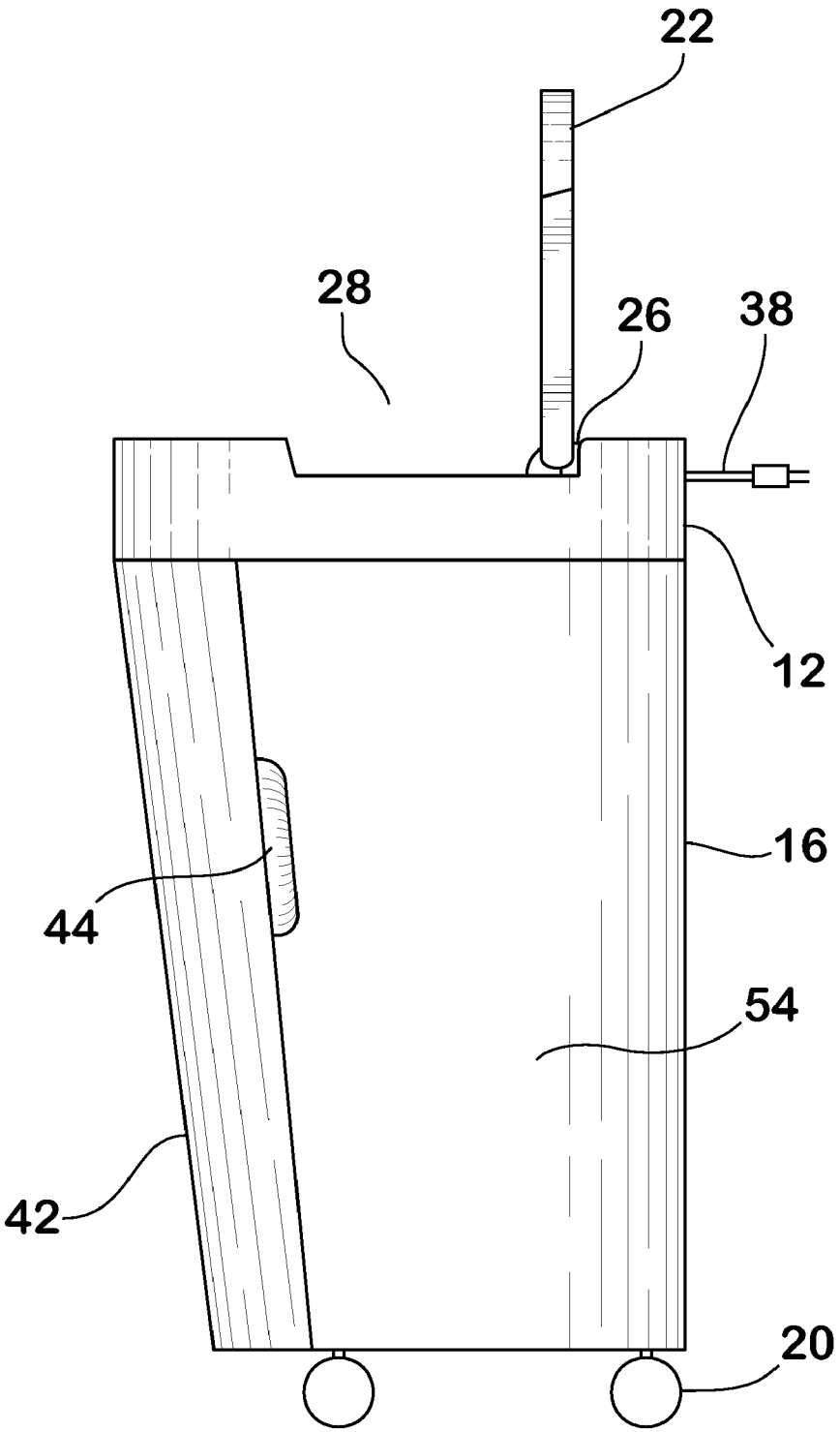
FIG. 6 is a right side elevational view of the shredder of FIG. 1 illustrating the top panel in its second, open position; a preferred recess in the right lateral side of the shredder housing adjacent to the front panel of the shredder housing allows the front panel to be easily opened.

Referring to FIG. 6, the right side 54 of the shredder housing 16 preferably includes a recess 44 at the junction between the right side 54 of the shredder housing 16 and the front panel 42. The front panel 42 is shown in its closed position. The recess 44 enables a user to easily open the front panel 42. Alternatively, the front panel may be automatically released using a selectable control.

Figure 7:
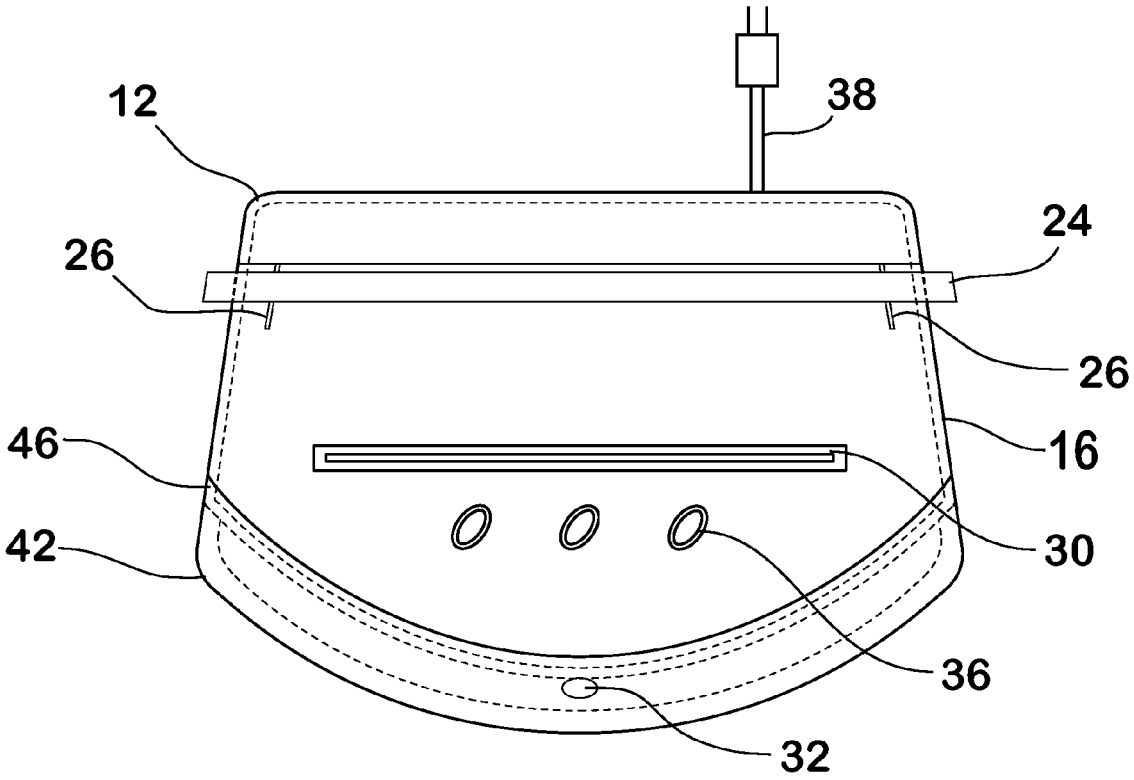
FIG. 7 is a top view of the shredder of FIG. 1 illustrating the relative positions of the top panel in its second, open position, the slot, and the selectable controls; A control may be located on the upper surface of the panel that is used to operate/secure the top panel; The optional control is shown proximate to the front of the shredder below the recess that is configured to receive the top panel therein.

Referring to FIG. 7, the front side 48 of the shredder 10 may be formed by an arcuate member which is shared by the shredder head 12 and the front panel 42 of the shredder housing 16, and which forms a smooth and aesthetically pleasing front surface 48. The forward edge of the recess 28 in the major surface 14 of the shredder head 12 forms a parallel arc which complements the shape of the front surface 48 of the shredder 10.

Figure 8:
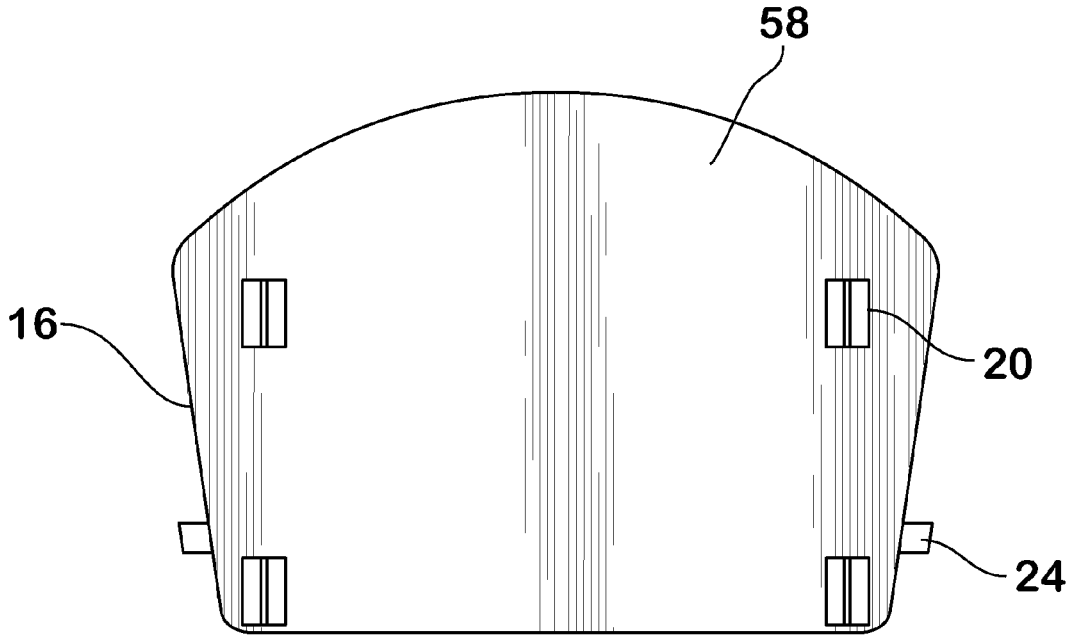
FIG. 8 is a bottom plan view of the shredder of FIG. 1 illustrating the preferred generally trapezoidal shape with rounded front panel, wheels may be located thereon and can be located as desired; An upper edge of the top panel is viewable because the top panel is in the second, open position.

Referring to FIG. 8, the shredder 10 of FIG. 1 is shown in bottom view with the top panel 22 in its second, open position. The edges of the top panel extend past the left and right sides 52, 54 of the shredder 10 and are visible in this view. The bottom surface 50 may be the attachment point for a plurality of wheels 20. The shredder has a generally rectilinear shape 10, with an arcuate member comprising the front surface 48. The wheels 20 are preferably four in number and are located at the corners of the bottom surface to evenly distribute the weight of the shredder 10.

Figure 9:
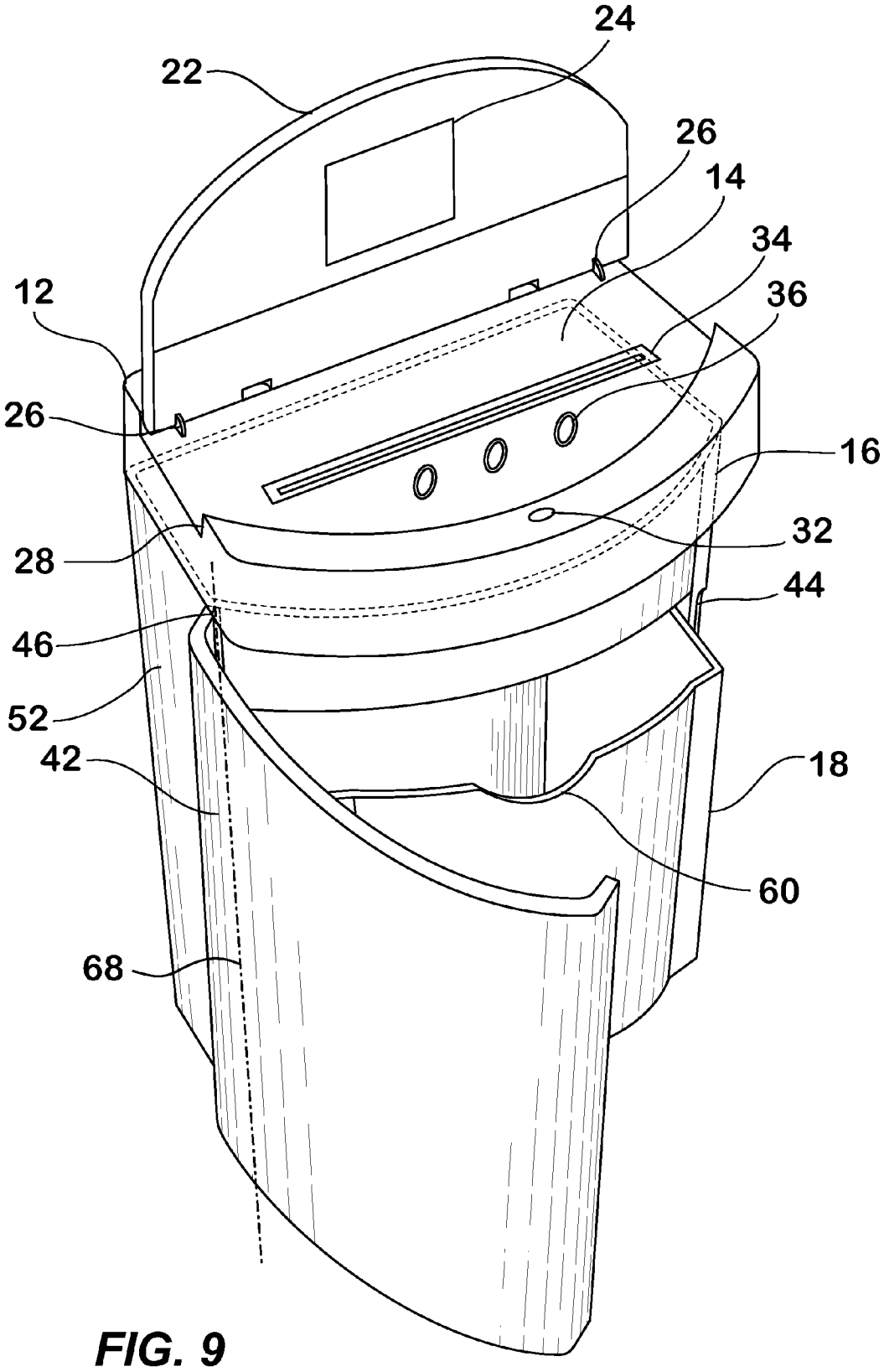
FIG. 9 is a perspective view of the shredder of FIG. 1 illustrating the top panel in its second, open position; The front panel of the shredder housing is in the open position with the front panel partially rotated about a generally vertical axis that is generally defined by the pivotal connection between the front panel and the remainder of the shredder housing; When the front panel is open, the shredder basket can be removed (and is shown partially removed from the shredder housing); The shredder basket preferably includes a notch to facilitate withdrawal from the shredder housing; The shredder housing may include a lock on the front panel that is only disengaged when the proper code is typed into the display or entered via a selectable control.

Referring to FIG. 9, the shredder housing 16 is in its open position. The shredder basket 18 is visible in this view and is shown partially removed from the shredder housing 16. The front and lateral sides of the shredder housing generally define a volume in which the shredder basket 18 is located. In its operating position, the shredder basket 18 is enclosed by the shredder housing 16 and the front panel 42, and is positioned to receive material shredded by the plurality of shredder blades 40. When the shredder is operating, the front panel 42 is in its closed position as shown in FIG. 2 and access to the shredder basket 18 is prevented. The front panel 42 preferably forms the front side of the shredder housing and extends along a portion of each of the lateral sides 52 of the shredder housing 16. The front panel 42 contacts the left side 52 of the shredder housing at the front panel pivot 46. The front panel pivot 46 is preferably a hinge which allows the front panel to pivot through an angle of at least ninety (90) degrees. The front panel 42 can be laterally pivoted about the front panel pivot 46 to its open position. When the front panel is in its open position, the shredder basket 18 can be accessed and emptied of shredded material by the user. The shredder basket 18 may include a notch 60 to facilitate removal from the shredder housing.

Figure 10:
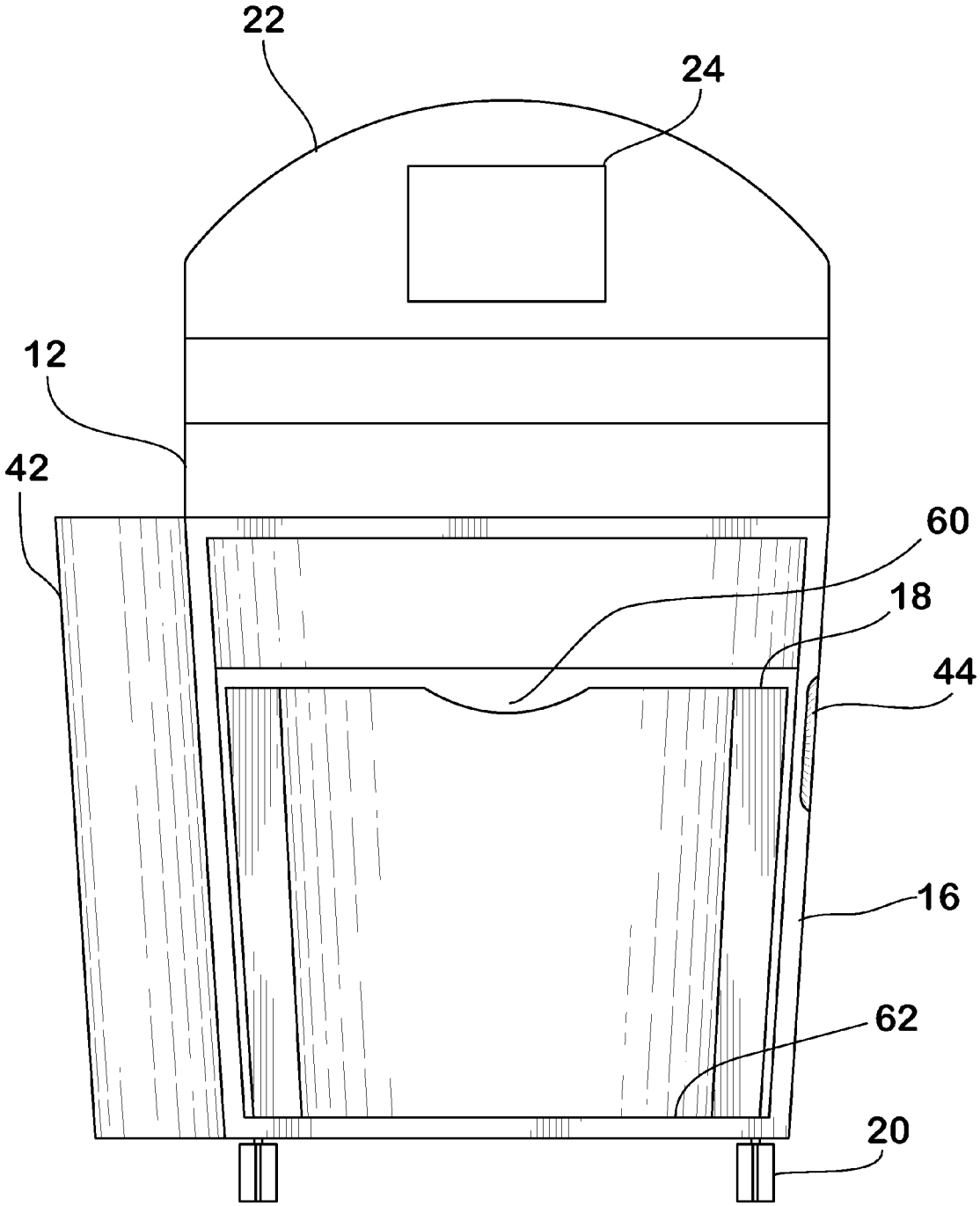
FIG. 10 is a front elevational view of the shredder of FIG. 1 illustrating the top panel in its second, open position; The front panel is in its open position, and the shredder basket is fully inserted in the shredder housing.

Referring to FIG. 10, the shredder basket 18 is preferably located on the base 62 of the shredder housing. The notch 60 in the shredder basket 18 allows a user to pull the shredder basket 18 generally forwards its position on the base 62 of the shredder housing by making a wider opening between the shredder basket 18 and the shredder housing 16. In this manner the user can grasp the basket 18 and pull it towards the front of the shredder 10.

Figure 11:
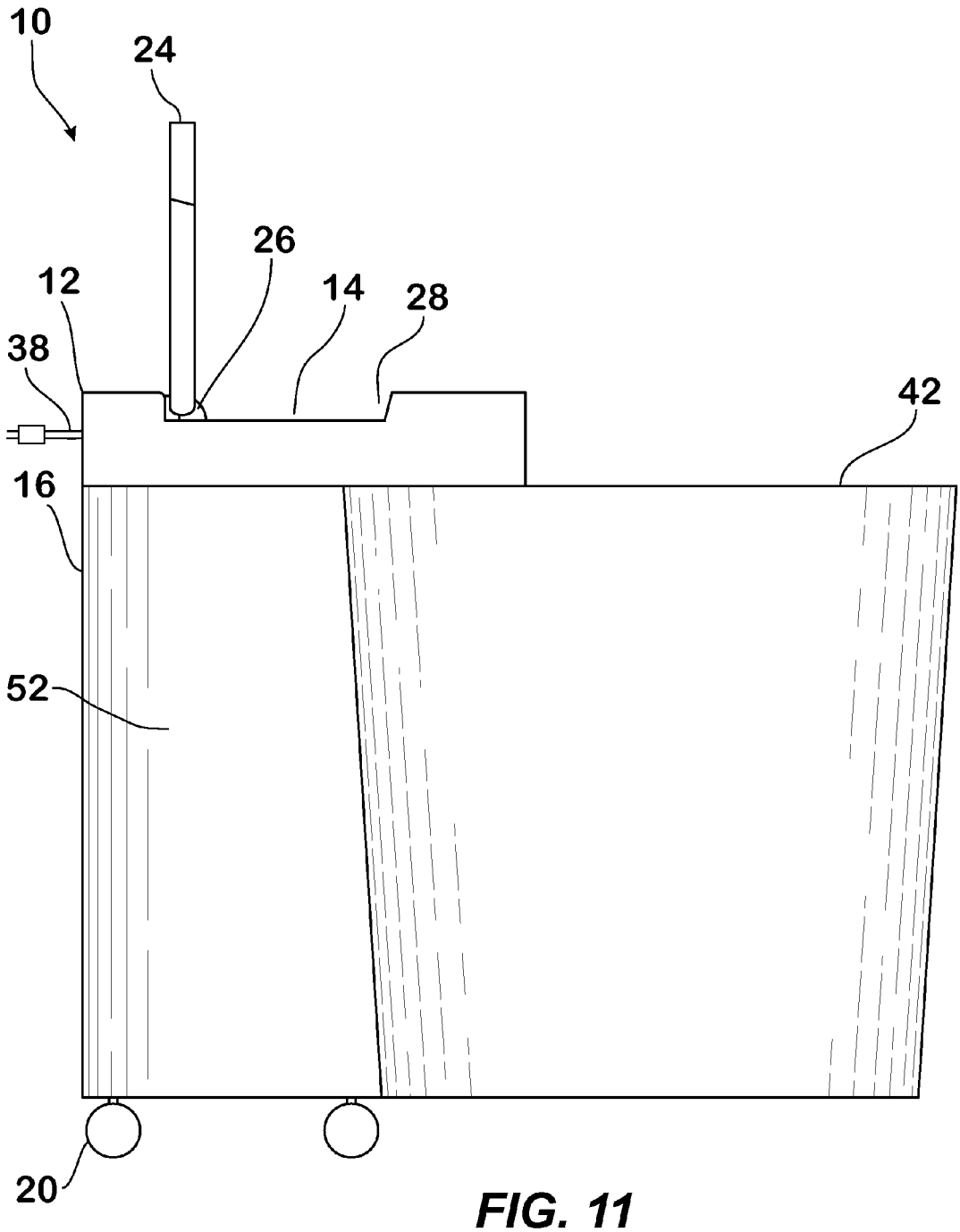
FIG. 11 is a left side elevational view of the shredder of FIG. 1 illustrating the top panel in its second, open position and the front panel of the shredder housing in its open position.

Referring to FIG. 11, the shredder top panel 22 is in the second, open position and the front panel 42 of the shredder housing 16 in its open position. In the front panel's open position, the front panel 42 of the shredder housing 16 generally faces in the same direction as the right side 52 of the shredder.

Figure 12:
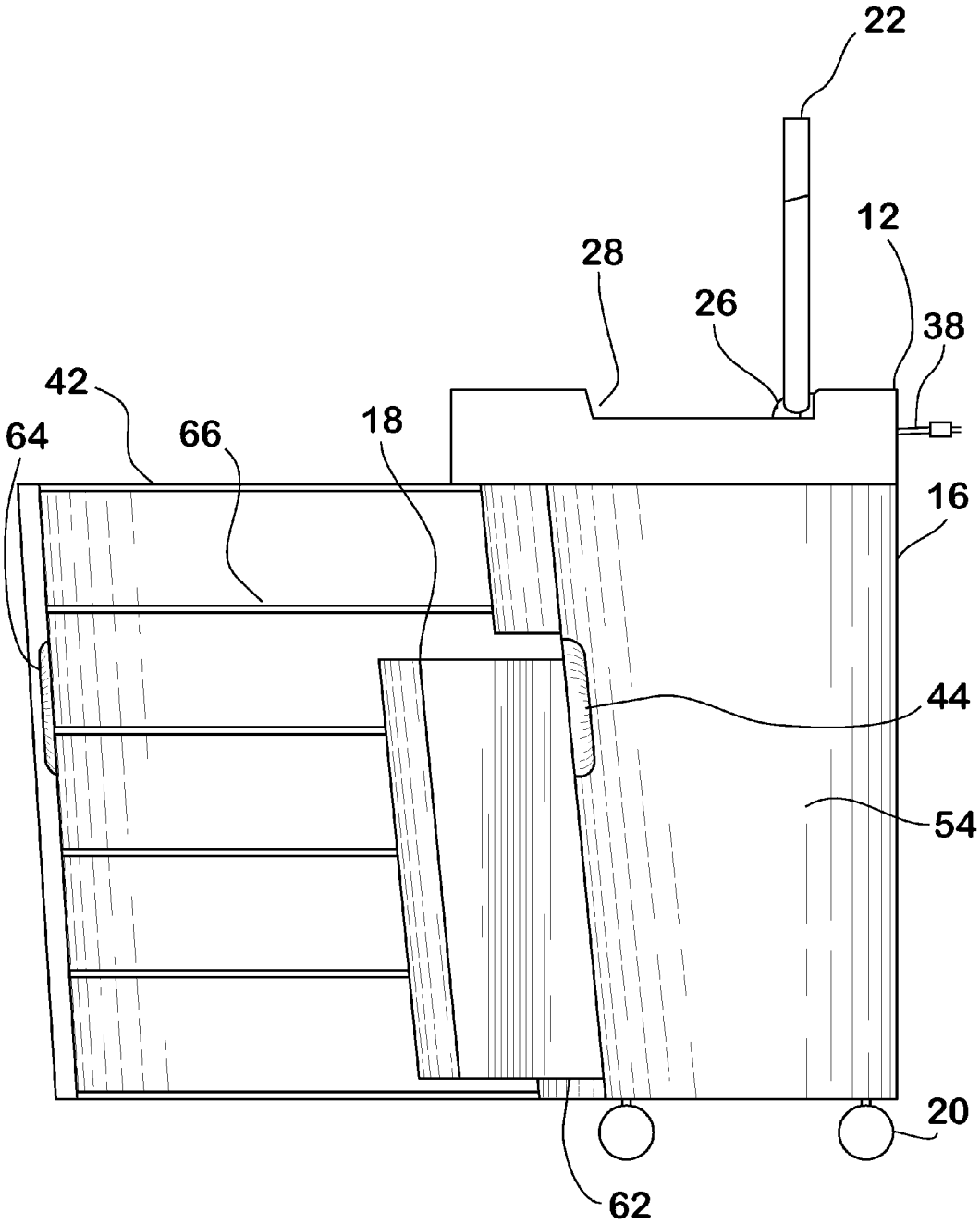
FIG. 12 is a right side elevational view of the shredder of FIG. 6 illustrating the top panel in its second, open position, the front panel of the shredder housing is in the open position, and the shredder basket is partially removed from the shredder housing; It is preferred, but not necessary, that the front panel is reinforced by ribs located on an inner surface thereof.

Referring to FIG. 12, the shredder basket 18 is visible and is partially removed from its operating position on the base 62 of the shredder housing 16. The front panel 42 of the shredder housing 16 may include a recess 64. Together with the recess 44 in the right side 54 of the shredder housing 16, the recess 64 facilitates the opening of the front panel 42 by the user. The front panel 42 may include transverse ribs 66 which increase structural rigidity while minimizing weight, and allow the front panel 42 to be opened smoothly without deforming its shape.

Figure 13:
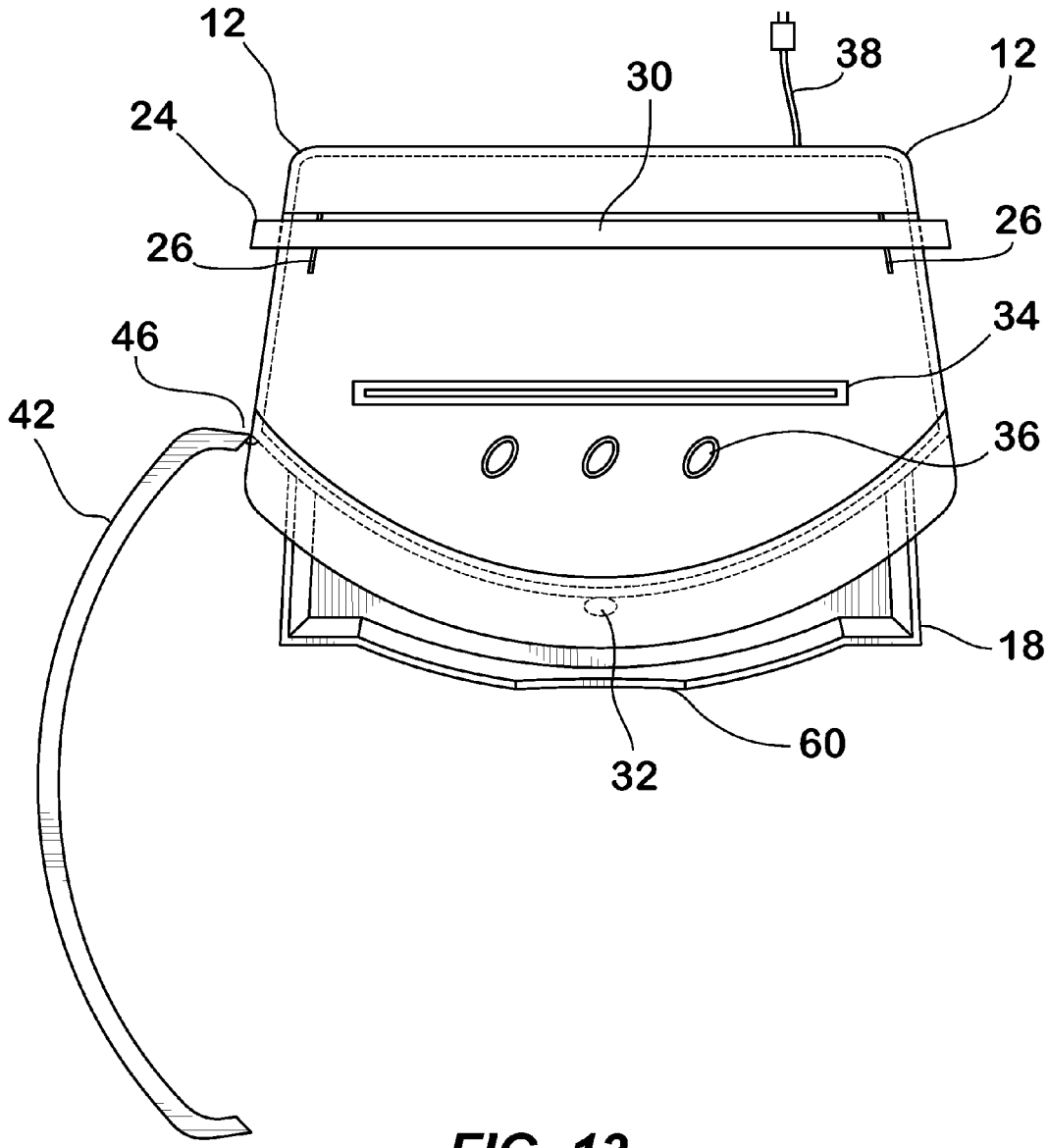
FIG. 13 is a top plan view of the shredder of FIG. 6 illustrating the top panel in its second, open position, the front panel of the shredder housing in the open position, and the shredder basket is partially removed from the shredder housing.

Referring to FIG. 13, the front panel 42 pivots about the front panel pivot 46 to preferably form an angle of approximately ninety (90) degrees from its closed position along the front surface 48 of the shredder 10. However, the front panel 42 of the shredder housing 16 can pivot to any angle sufficient to allow unimpeded movement of the shredder basket 18 as it is removed from the shredder housing 16 without departing from the scope of the present invention.

Figure 14:
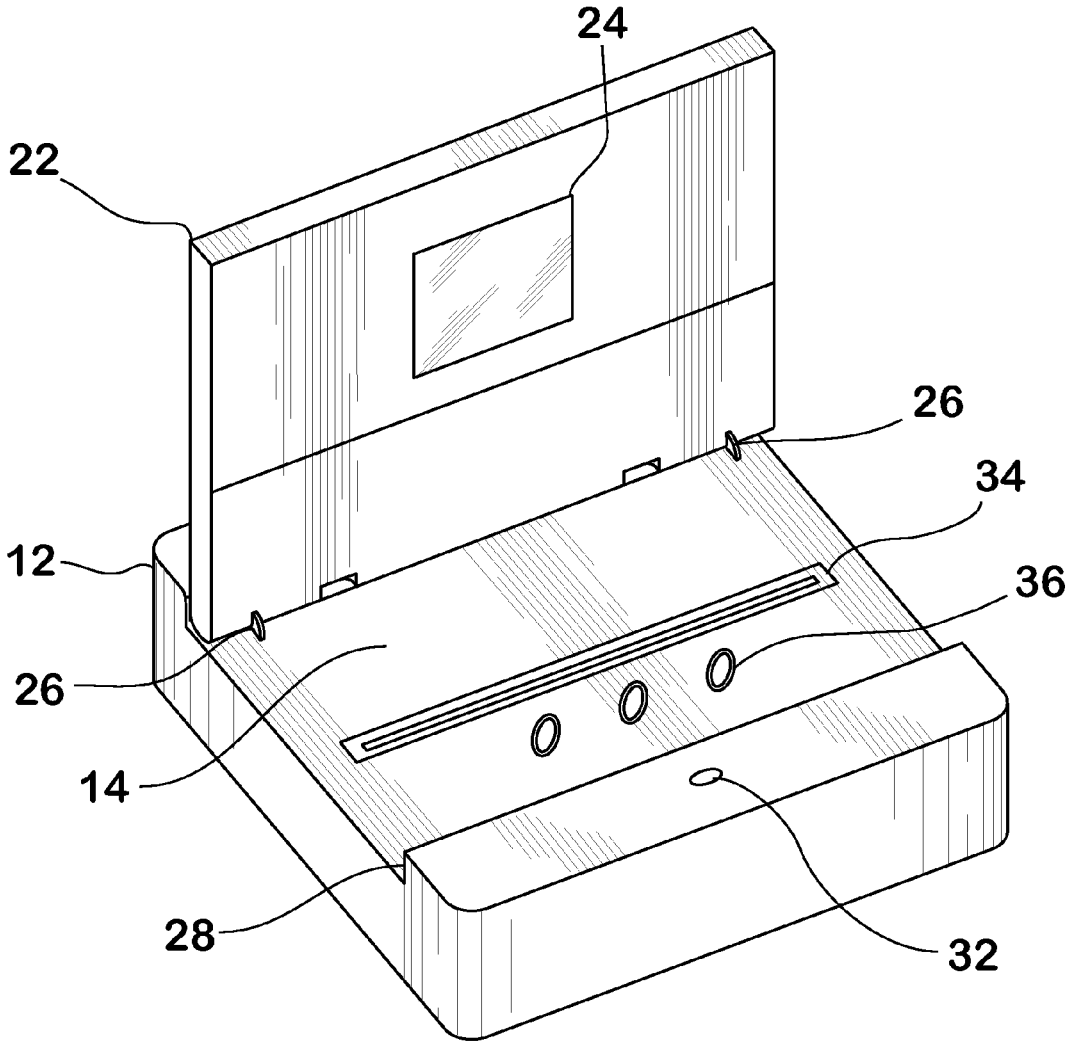
FIG. 14 is a perspective view of a shredder head according to a second preferred embodiment of the present invention and illustrates the top panel in its second, open position which allows access to the slot and possibly to the at least one selectable control; The shredder head preferably has a generally square configuration and a display located in the top panel; However, those of ordinary skill in the art will appreciate from this disclosure that the shredder and/or shredder head of the present invention can have any shape without departing from the scope of the present invention.

FIG. 14 shows a second preferred embodiment of a shredder head 12 according to the present invention. Briefly speaking, the shredder head has a major surface 14 which defines a slot 34 adapted to receive material to be shredded. A top panel 22 is located on the major surface 14 of the shredder head 12, and is attached to the shredder head 12 at a pivot 26. The pivot 26 enables the top panel 22 to move between a first, closed position and a second, open position. In its first, closed position, the top panel 22 covers the shredder slot 34. The top panel 22 is shown in its second, open position, and it is positioned to allow access to the slot 34. The top panel includes a display 24. The display 24 is preferably configured such that it is not visible when the top panel 22 is in the first, closed position.

The major surface 14 of the shredder head 12 preferably defines a recess 30. When the top panel 22 is in its first, closed position, the exposed surface of the top panel 22 is flush with the non-recessed portion of the major surface 14, such that in this configuration the shredder head 10 is an aesthetically pleasing shape which covers the slot 36.

Figure 15:
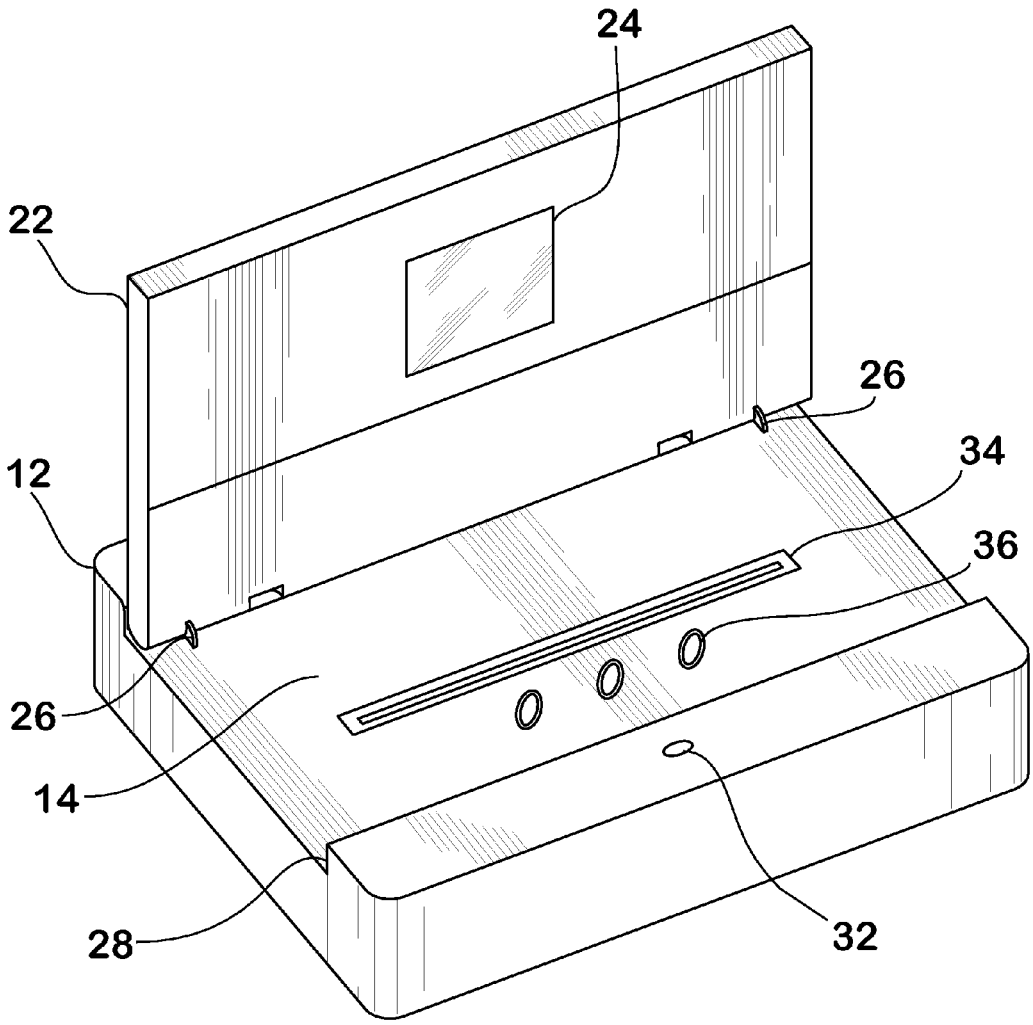
FIG. 15 is a perspective view of a shredder head according to a third preferred embodiment of the present invention illustrating the top panel in its second, open position which preferably allows access to the slot and the at least one selectable control; the shredder head preferably has a generally rectangular configuration.

FIG. 15 shows another preferred embodiment of a shredder head 12 according to the present invention. The present invention can be adapted to any size, shape or configuration of shredder head 12 without departing from the broad inventive concept.

Referring to FIGS. 14-15, while the preferred shredder head 12 may have a generally rectilinear shape, and while the top panel 22 in its first position forms a generally level surface together with the major surface 14 of the shredder head 12, those of ordinary skill in the art will appreciate from this disclosure that the shredder head 12 can have any shape without departing from the scope of the present invention.

While specific shredder and shredder head configurations have been described above, those of ordinary skill in the art will appreciate that the present invention can be used with shredders and/or shredder heads of any configuration without departing from the scope of the present invention. It is recognized by those skilled in the art that changes may be made to the above shredder 10 and/or shredder head 12 without departing from the broad inventive concept thereof. It is understood, therefore, that this invention is not limited to the particular embodiments disclosed, but is intended cover all modifications which are within the spirit and scope of the invention as defined by the above specification, the appended claims and/or shown in the attached drawings.

What is claimed is:

1. A shredder, comprising:

a shredder head having a major surface defining a slot adapted to receive material to be shredded, at least one selectable control being located on the major surface, a top panel is pivotally located on the major surface and is moveable between a first position, in which the top panel covers the slot and the at least one selectable control, and a second position, in which the top panel is positioned to allow access to the slot and to the at least one control, wherein the major surface defines a recess for receiving the top panel when the top panel is in the first position such that an upper surface of the shredder is generally flush with the top panel while the top panel is in the first position;

a plurality of shredder blades disposed within the shredder head and adapted to shred the material inserted into the slot; and the shredder being configured to shred material only while the top panel is in the second position, wherein the top panel further comprises a display therein, the display comprising an electronic display screen, wherein the display is configured such that the display is not viewable when the top panel is in the first position.

2. The shredder of claim 1, further comprising a securing mechanism adapted to, when the top panel is in the first position, prevent unauthorized moving of the top panel into the second position.

3. The shredder of claim 2, wherein the securing mechanism is a biometric sensor that must be activated prior to rotating the top panel out of the first position.

4. The shredder of claim 3, wherein the shredder is configured such that when the biometric sensor is activated, the top panel automatically moves into the second position and the plurality of shredder blades are activated.

5. The shredder of claim 2, wherein the securing mechanism is a lock that must be disengaged prior to rotating the top panel out of the first position.

6. The shredder of claim 1, wherein the plurality of shredder blades are automatically deactivated when the top panel is moved into the first position.

7. The shredder of claim 6, wherein the movement of the top panel from the first position to the second position puts the shredder into an activated state in which the plurality of shredder blades will activate when material is placed into the slot of the shredder.

8. The shredder of claim 1, further comprising a top panel selectable control that, when activated, causes the top panel to automatically move from the second position to the first position.

9. The shredder of claim 1 further comprising:

a shredder housing having front and lateral sides;

a shredder basket located within the shredder housing and generally positioned to received material shredded by the plurality of shredder blades;

the shredder housing comprising a front panel that is laterally pivotable about a generally vertical axis between a closed position, in which access to the shredder basket is prevented, and an open position, in which the shredder basket can be accessed;

wherein the front panel extends along the front side of the shredder housing and along a portion of each of the lateral sides of the shredder housing.

10. The shredder of claim 1, wherein the movement of the top panel from the first position to the second position functions to activate the shredder, and the movement of the top panel from the second position to the first position functions to deactivate the shredder.

11. A shredder, comprising:

a shredder head having a major surface defining a slot adapted to receive material to be shredded, a top panel is pivotally located on the major surface and is moveable between a first position, in which the top panel covers the slot, and a second position, in which the top panel is positioned to allow access to the slot;

a plurality of shredder blades disposed within the shredder head and adapted to shred the material inserted into the slot;

wherein the top panel further comprises a display therein, the display comprising an electronic display screen, the display being configured such that the display is not viewable when the top panel is in the first position;

a shredder basket generally positioned to received material shredded by the plurality of shredder blades;

a shredder housing having front and lateral sides and enclosing at least the shredder basket, the shredder housing comprising a front panel that is laterally pivotable about a generally vertical axis between a closed position, in which access to the shredder basket is prevented, and an open position, in which the shredder basket can be accessed;

the shredder being configured to shred material only while the top panel is in the second position, wherein the front panel extends along the front side of the shredder housing and along a portion of each of the lateral sides of the shredder housing.

12. The shredder of claim 11, wherein the major surface defines a recess for receiving the top panel when the top panel is in the first position such that an upper surface of the shredder is generally flush with the top panel while the top panel is in the first position.

13. The shredder of claim 12, further comprising a securing mechanism adapted to, when the top panel is in the first position, prevent unauthorized moving of the top panel into the second position.

14. The shredder of claim 13, wherein the securing mechanism is a biometric sensor that must be activated prior to rotating the top panel out of the first position.

15. The shredder of claim 14, wherein the shredder is configured such that when the biometric sensor is activated, the top panel automatically moves into the second position and the plurality of shredder blades are activated.

16. The shredder of claim 11, wherein the shredder is configured to automatically move the top panel into the first position when the shredder blades have been deactivated for a predetermined period of time.

17. A shredder, comprising:

a shredder head having a major surface defining a slot adapted to receive material to be shredded, a top panel is pivotally located on the major surface and is moveable between a first position, in which the top panel covers the slot and, and a second position, in which the top panel is positioned to allow access to the slot, wherein the major surface defines a recess for receiving the top panel when the top panel is in the first position such that an upper surface of the shredder is generally flush with the top panel while the top panel is in the first position;

a plurality of shredder blades disposed within the shredder head and adapted to shred the material inserted into the slot; and the shredder being configured to shred material only while the top panel is in the second position, wherein the top panel further comprises a display therein, the display comprising an electronic display screen, the shredder head being configured to automatically move the top panel into the first position if no material has been inserted into the slot for a predetermined period of time, wherein the display is configured such that the display is not viewable when the top panel is in the first position.

18. The shredder of claim 17 further comprising:

a shredder housing having front and lateral sides;

a shredder basket located within the shredder housing and generally positioned to received material shredded by the plurality of shredder blades;

the shredder housing comprising a front panel that is laterally pivotable about a generally vertical axis between a closed position, in which access to the shredder basket is prevented, and an open position, in which the shredder basket can be accessed;

wherein the front panel extends along the front side of the shredder housing and along a portion of each of the lateral sides of the shredder housing.

19. A shredder head, comprising:

the shredder head having a major surface defining a slot adapted to receive material to be shredded, a top panel is pivotally located on the major surface and is moveable between a first position, in which the top panel covers the slot, and a second position, in which the top panel is positioned to allow access to the slot, wherein the major surface defines a recess for receiving the top panel when the top panel is in the first position such that an upper surface of the shredder is generally flush with the top panel while the top panel is in the first position;

a plurality of shredder blades disposed within the shredder head and adapted to shred the material inserted into the slot; and the shredder being configured to shred material only while the top panel is in the second position, wherein the top panel further comprises a display therein, the display comprising an electronic display screen, wherein the display is configured such that the display is not viewable when the top panel is in the first position, the shredder head being configured to automatically move the top panel into the first position if no material has been inserted into the slot for a predetermined period of time.

* * * * *